US008574371B2

(12) United States Patent
Folz et al.

(10) Patent No.: US 8,574,371 B2
(45) Date of Patent: Nov. 5, 2013

(54) METHOD FOR CLEANING CONTAINERS AND CLEANING MACHINE

(75) Inventors: Cornelia Folz, Berlin (DE); Jan Momsen, Bredstedt (DE); Heinz Humele, Thalmassing (DE); Timm Kirchhoff, Westerholz (DE); Klaus-Karl Wasmuht, Ellingen (DE); Bernd Hansen, Rantrum (DE); Thomas Islinger, Lappersdorf (DE); Christoph Weinholzer, Straubing (DE)

(73) Assignee: Krones AG, Neutraubling (DE)

( * ) Notice: Subject to any disclaimer, the term of this patent is extended or adjusted under 35 U.S.C. 154(b) by 407 days.

(21) Appl. No.: 12/871,010

(22) Filed: Aug. 30, 2010

(65) Prior Publication Data

US 2011/0067730 A1 Mar. 24, 2011

(30) Foreign Application Priority Data

Sep. 2, 2009 (DE) ..... 10 2009 039 762

(51) Int. Cl.
*B08B 7/02* (2006.01)

(52) U.S. Cl.
USPC ..... 134/7; 451/38; 451/39; 451/40; 451/76; 451/80; 45/81; 45/82; 45/83; 134/6; 134/8; 134/22.1; 134/22.12; 134/22.18; 134/26; 134/30; 134/32; 134/33; 134/34; 134/35; 134/37; 134/42

(58) Field of Classification Search
USPC ..... 451/38, 39, 40, 76, 80, 81, 82, 83; 134/6, 8, 22.1, 22.12, 22.18, 26, 30, 134/32, 33, 34, 35, 37, 42
See application file for complete search history.

(56) References Cited

U.S. PATENT DOCUMENTS 2,421,849 A * 6/1947 Potter ..... 29/81.06
3,508,997 A * 4/1970 McKenney ..... 156/389

(Continued)

FOREIGN PATENT DOCUMENTS

DE 64129 C 11/1892
DE 197053 C 4/1908

(Continued)

OTHER PUBLICATIONS

German Search Report for DE 10 2009 039 762.0, dated Jun. 21, 2010.

(Continued)

*Primary Examiner* — Bibi Carrillo
(74) *Attorney, Agent, or Firm* — Marshall, Gerstein & Borun LLP

(57) ABSTRACT

A method for cleaning containers, in particular bottles of glass or plastics, and a cleaning machine with at least one cleaning medium, with the containers cleaned at least in one station preferential for the cleaning result and/or in a procedure step with at least essentially chemical-free cleaning media. The cleaning medium is advantageously a granular material, in particular granular ice, carried under pressure with compressed air or compressed water. The cleaning machine suited for carrying out the method includes downstream of an unpacking and presoaking station, a pre-cleaning station with a high pressure water blasting pre-cleaning section, and subsequently an intensive cleaning station with at least one intensive cleaning section to which a pressure blasting system for chemical-free, granular material and a carrier medium are associated, and a disinfection station following the intensive cleaning station.

14 Claims, 3 Drawing Sheets

(56) References Cited

U.S. PATENT DOCUMENTS

| | | | | |
|---|---|---|---|---|
| 5,417,608 | A * | 5/1995 | Elliott | 451/81 |
| 5,593,339 | A * | 1/1997 | Yam et al. | 451/36 |
| 6,113,475 | A * | 9/2000 | Masuda et al. | 451/76 |
| 7,374,855 | B2 * | 5/2008 | Wayman et al. | 430/127 |
| 2003/0015223 | A1 | 1/2003 | Jacksier et al. | |

FOREIGN PATENT DOCUMENTS

| | | | |
|---|---|---|---|
| DE | 598606 | C | 6/1934 |
| DE | 19628842 | A1 | 2/1998 |
| DE | 19709621 | A1 | 9/1998 |
| EP | 0672615 | A1 | 9/1995 |
| EP | 1787662 | A1 | 5/2007 |
| FR | 644426 | A | 10/1928 |
| GB | 5471 | | 0/1909 |
| GB | 22367 | | 1/1905 |
| GB | 722399 | A | 1/1955 |
| WO | WO-2007051473 | A1 | 5/2007 |
| WO | WO-2009018929 | A1 | 2/2009 |

OTHER PUBLICATIONS

European Search Report for EP 10166144.5, dated Nov. 30, 2010.

Notification of the Second Office Action and English translation from The State Intellectual Property Office of the People's Republic of China for application No. 20101027218.8, dated Apr. 3, 2013.

* cited by examiner

METHOD FOR CLEANING CONTAINERS AND CLEANING MACHINE

CROSS-REFERENCE TO RELATED APPLICATION

The present application claims the benefit of priority of German Application No. 102009039762.0, filed Sep. 2, 2009. The entire text of the priority application is incorporated herein by reference in its entirety.

FIELD OF THE DISCLOSURE

The disclosure relates to a method and a cleaning machine for cleaning containers, such as in beverage bottling operations.

BACKGROUND

It is known, for example in the beverage industry to employ a considerable amount of chemicals, such as caustic solutions or acids, directly at or in the containers and possibly also work with heat for cleaning containers, in particular bottles of plastics or glass, in connection with water. These well-known methods require a considerable amount of water and chemicals per container to be cleaned as well as a considerable amount of energy for generating heat. The high amount of water required is, among others, due to the chemicals not only having to be employed in a certain dilution for cleaning, but also having to be removed without leaving any residue. This results in an enormous amount of costs for cleaning the containers and can also lead to indirect additional costs if, due to the chemicals not having been completely removed without leaving any residue, product recalls for beverages filled into the containers and contaminated by chemical residues become necessary. In filling and packaging engineering, for example for returnable bottles of glass or plastics, the employed cleaning machine is the highest consumer of thermal energy and chemicals, for example in the form of caustic solutions. For example, approximately 30 kJ of thermal energy and approximately 20 ml of a 2.5% caustic solution are required per bottle to be cleaned.

From EP 1 787 662 A, a modular washing and sterilizing machine is known in which dirty objects, in particular used medical instruments, are cleaned and subsequently disinfected in several stations. In a pretreatment station, the dirty objects are prewashed with cold water and/or treated in an ultrasonic bath in one or several cleaning steps. In at least one subsequent washing station, washing is performed with hot water, optionally with added detergents, and here, hot disinfection with subsequent rinsing and drying in a drying chamber is accomplished. The washing operations are performed in washing chambers into which the dirty objects are transported with carts. Hot disinfection is performed with hot water at a temperature of, for example, 90° C. to 93° C. As pretreatment requires less time than the main washing operation with hot disinfection and drying, several parallel main washing stations are employed.

In WO 2007/051473 A, it is suggested to intensively clean returnable glass bottles with a glass powder blasted through a high-pressure medium. For plastic bottles, glass powder is extremely abrasive.

From DE 196 28 842 A, a method for cleaning metallic bottles, such as diving bottles or compressed air bottles, is known, wherein, for internal cleaning, a cleaning substance with granular, abrasive particles of glass scrap of e.g. hardened glass is filled into the bottle either in a dry state or in a liquid, and the bottle is then set in relative motion relative to the cleaning substance. The relative motion comprises a rotation of the bottle about its longitudinal axis and additionally cyclic tilting motions transversely thereto.

SUMMARY OF THE DISCLOSURE

An aspect underlying the disclosure is to provide a method of the type mentioned in the beginning as well as a cleaning machine for performing the method which permit reliable cleaning at least essentially without any chemicals with a reduced amount of energy required. One part of the aspect is the provision of a cleaning machine for bottles that can be operated nearly without any heat and largely or completely without any chemicals and thus can be operated very inexpensively.

As with respect to the method, at least the cleaning of the containers is carried out in a procedure step preferential for the cleaning effect to be achieved or in at least one station of the cleaning machine at least largely with chemical-free cleaning media, and in the process hardly any thermal energy nor chemicals are employed, the costs for container cleaning can be considerably reduced. As no chemicals are employed, the residual risk including additional costs for product recalls is considerably reduced.

In the cleaning machine, intensive cleaning is carried out such that at least the same cleaning effect as in conventional cleaning machines is achieved, without having to employ any noteworthy amount of thermal energy and/or chemicals. The pre-cleaning station operates without chemicals with pre-soaking and high pressure water blasting. In the intensive cleaning station, chemical-free, granular cleaning material is blasted under pressure, which either develops an intensive cleaning effect at the direct impact and/or removes and rinses off dirt accumulations by subsequent relative motions and frictional influences, and in the disinfection station, sufficient sterility of the intensively cleaned containers is achieved.

Particularly advantageously, blast cleaning is performed at least in the intensive cleaning station e.g. with compressed water or air as carrier medium and granular material carried by the carrier medium. The granular material can be recyclable or degradable without leaving any residue or reprocessable, and first develops an intensive, abrasive cleaning effect for dirt accumulations even without the application of heat.

According to the method, metal, plastics, sand, salt or similar granular material is employed as granular material (alone or in combination).

As an alternative, in a particularly advantageous method variant, cleaning is performed e.g. with granular ice carried in compressed air or compressed water. Together with the abrasive cleaning effect, a particularly efficient cold shock for the dirt accumulations occurs through which dirt accumulations embrittle and contract and can thus be easily released and removed. For this, either dry ice of carbon dioxide or water ice (slurry ice) of chemical-free water is advantageously blasted as granular ice. The dry ice is completely converted into carbon dioxide without leaving any residue during the intensive cleaning, the carbon dioxide optionally being sucked off. The water ice, which melts during intensive cleaning, rinses away released dirt accumulations. With approximately the same energy demand, the water demand with granular ice as well as the waste water amount is, compared to conventional water-based methods with chemicals, lower by 90% to 95%. Furthermore, no damages result not even on sensitive surfaces as the ice grains have a gentle effect and no dust which would have to be removed separately develops. Compared to a water jet pressure washer with a water consumption of up to 500 liters per hour, in cleaning with water ice, e.g. slurry ice, only 55 liters of water are consumed per hour. The intensive cleaning success with ice grains for example formed as pellets is based on the cooling and embrittlement effect and the mechanical abrasive effect. Especially with dry ice, no liquid residues are formed after intensive cleaning. Here, e.g. in intensive cleaning, ice grains having a size of 1.0 mm to 5.0 mm, preferably about 2.0 mm, preferably pellets, are blasted at a pressure of about 3.0 bar to 15.0 bar, preferably about 5.0 bar, and/or a speed of about 150 m/s to 500 m/s, preferably about 300 m/s. This leads to an intensive cleaning effect within a relatively short time, preferably in the interior of the containers and the opening region.

In an advantageous method variant, for cleaning, a granulated nutshell material as granular material is allowed to act on the container surface by means of a carrier medium such that the granulated nutshell material performs a relative motion at the container surface. Granulated nutshell material is not only an inexpensive, "renewable" cleaning medium, but also brings about a surprisingly efficient cleaning effect. Granulated nutshell material is available almost all over the world in large amounts and specifications and perfectly suited universally for cleaning containers consisting of glass as well as plastic containers, such as PET bottles, as it develops a moderate abrasive effect. Furthermore, granulated nutshell material can be possibly used several times and is in any case easily biodegradable. With granulated nutshell material, not only labels, label residues and glue can be quickly and efficiently removed from the external surface, but also e.g. standard dirt accumulations from the internal surface of the containers. Here, a granulated nutshell material having a particle size of about 0.1 mm to about 1.0 mm, preferably up to about 0.8 mm, is allowed to act on the external and/or internal container surface, possibly either in a dry state or with water as carrier medium.

According to a further, important idea, the granular material, in particular the ice, is blasted into the container under pressure together with the carrier material to blast the internal surface, and preferably, a relative rotary motion between the container and the pressure jets is generated subsequently or simultaneously, and the blasted internal surface is again worked with the granular material and the carrier material, rinsed and finally cleaned.

In an advantageous embodiment, the granular material is disinfected before the intensive cleaning process step in order not to introduce any germs from outside. To be able to keep the costs for the required material as low as possible, it is advantageous to collect excessive and/or used cleaning media and to reprocess them at least as far as possible. This is mainly true for water as carrier medium or melt water from the ice which is disposed of the removed dirt accumulations and cleaned, and employed again in the cycle. Here, it is important to perform the intensive cleaning of the containers at least essentially without adding heat to the cleaning medium or the containers to save costs.

In an advantageous method variant, for cleaning the container internal surface, the container is at least partially filled with at least the granular material, preferably with a mixture of water and granulated nutshell material or only with granulated nutshell material, and the container is shaken to exert the abrasive effect at the internal surface. The shaking movement can be possibly superimposed by a rotary motion of the container. Standard dirt accumulations of the internal surface are thus particularly efficiently and quickly removed.

In a concrete method variant, each container is wetted with chemical-free water in at least one pre-cleaning step, and dirt accumulations are presoaked for a predetermined period. Then, mainly external dirt accumulations are removed by high pressure water jets of chemical-free water. This is performed mainly at the outside of the container, e.g. at the label or a wrap-around label. Subsequently, the container is intensively blast-cleaned with the granular material, for at least one further period that also depends on the level of dirt, and then, it is rinsed with chemical-free water. The container is then already clean, but for hygienic reasons, a chemical-free disinfection of the container, at least inside and in the opening region, is finally performed. Then, the container, preferably a returnable bottle, is ready for filling.

The chemical-free disinfection can be performed by applying and burning gas or a substance that is combustible without leaving any residue, i.e. by flame disinfection, where only a little energy is consumed for ignition.

As an alternative, disinfection with ozone can be efficiently performed, the ozone being subjected to energy pulses, also to be reliably consumed to form harmless components.

To carry out the intensive cleaning as efficiently as possible, it is advantageous for the containers to be intensively cleaned for a first or at least one second and longer period, depending on the level of dirt that can be better detected after pre-cleaning. The longer the intensive cleaning is performed, the more reliably even tenacious dirt accumulations are removed. This also means that each container is intensively cleaned just as long as it is required.

As a precaution, incompletely cleaned container can, even before disinfection, finally still be detected by inspection and either be sorted out, or returned to pre-cleaning or intensive cleaning. Thereby, the error rate of not sufficiently cleaned containers can be reduced to nearly zero.

In an advantageous embodiment of the cleaning machine, a reservoir for granular material, in particular for ice pellets, as well as a dosing device for the granular material, a blasting system with at least one blast gun and at least one blast nozzle are associated to the intensive cleaning station, wherein the blast nozzle and/or the blast gun can be, preferably and for increasing the cleaning effect, arranged to be moved and/or rotated under control. It can be optimally advantageous to provide a disinfection device for the granular material in order not to introduce any germs from outside during intensive cleaning.

In an advantageous embodiment of the cleaning machine, the reservoir, the material dosing device, and the blasting system are embodied for storing and processing granulated nutshell material as the granular material. This material-specific design especially allows for the processing characteristics of granulated nutshell material.

In a further embodiment, at least the pre-cleaning station and the intensive cleaning station comprise liquid collecting means that can be connected to cleaning and reprocessing means which are contained directly in the cleaning machine or placed outside the same. In this manner, at least water is employed in a cycle, with only negligibly low losses of waste water that actually has to be discharged. Released dirt accumulations are sorted out and removed.

In an advantageous embodiment, at least two intensive cleaning sections of different lengths are provided in the intensive cleaning station and linked in parallel by means of distributing guides. The distributing guides can be controlled by a container inspection station, depending on the detected level of dirt of the containers conveyed to the intensive cleaning station, so that each container individually is cleaned only as intensively as required in the specific case. The conveyor line in the cleaning machine can moreover run continuously or comprise sections of different rates of motion, e.g. with buffer sections, and auxiliary conveyor lines for a suspended transport of the containers if the main conveyor line is designed for upright transport. During the injection or blasting with the granular material, components of the blasting system can optionally move along, or the containers are optionally locally stopped temporarily.

In a further embodiment, an inspection station for sorting out and/or returning is provided between the intensive cleaning station and the disinfection station, and/or between the pre-cleaning station and the intensive cleaning station. In particular the inspection station between the intensive cleaning station and the disinfection station can be used to sort out containers that have not been sufficiently cleaned up to that point, or to return them to the pre-cleaning station or to the intensive cleaning station.

The cleaning machine can be designed as rotary machine or linear machine, e.g. depending on the available space.

Furthermore, in the cleaning machine, at least in the intensive cleaning station, rotary devices for the containers and/or the blast nozzles or blast guns can be provided to generate a relative rotary motion between the containers and the filled-in cleaning medium for intensifying or extending the cleaning, and upstream and/or downstream of the intensive cleaning station, or optionally also upstream of the pre-cleaning station, container turning devices can be provided. The turning devices change the position of the containers between a suspended position and an overhead position, and vice-versa, to permit optimal access for the cleaning medium for the different cleaning operations, to also empty or rinse the containers before final disinfection and present them in a clean and hardly wetted state for inspection and/or disinfection.

In an advantageous embodiment, at least in the intensive cleaning station, at least one container shaking device, preferably for standing or suspended or lying containers, is provided to more efficiently bring to bear the abrasive effect of the granular material, in particular a granulated nutshell material. For example, standard dirt of the internal surface can be thus released within a short time with a mixture of water and granulated nutshell material, preferably in a mixing ratio of about 50:50, and subsequently discharged easily. The container shaking device can be designed such that the shaking movement is optionally superimposed by a rotary motion of the container. Depending on the type of the container, it can be cleaned in a standing or suspended or lying state in the intensive cleaning.

Particularly advantageously, disinfection is performed with ozone which acts without the addition of heat and degrades without leaving any residue. For this, an ozone-fed applicator can be provided, as well as preferably an e.g. piezoelectric energy-pulse generator for the ozone.

The quintessence of the disclosure is to employ essentially no chemicals or no chemicals at all in the container cleaning process in a cleaning machine, but to work with chemical-free cleaning media which do not develop their cleaning effect in a chemical, but in another manner, e.g. physically and/or mechanically. This can be e.g. granular material having an abrasive effect when being blasted under pressure. The granular material releases dirt accumulations, carries away the released dirt accumulations and can be removed again without leaving any residue. If the granular material is ice, a cold shock effect which intensifies cleaning is added to the abrasive cleaning effect. All procedure steps can be performed essentially without heat or with the addition of only little heat to finally achieve a cleaning result which is at least as good as it was possible up to now only with the addition of a lot of water, chemicals and thermal energy. When working with granular material inside the container, the granular material is injected under pressure until a certain filling level is reached. During the injection, the inner walls can be blasted. Subsequently, during the further conveyance of the container, the filling with the granular material can generate an additional frictional cleaning effect by a relative and optionally heavy rotary motion being generated between the container and the filling which leads to a turbulent and cleaning relative flow along the inner wall of the container, where the granular material is also brought again into intimate cleaning contact with the inner walls by centrifugal force, and released dirt accumulations are kept moving until they are removed.

As the granular material, a granulated nutshell material is advantageously used, as this cleaning medium is not only highly efficient but originates to a practically unlimited degree from renewable raw materials, can be easily recycled and is in any case easily biodegradable. Granulated nutshell material cannot only be employed for blasting, but also in a dry filling of the containers or a filling blended with water, the containers being cleaned at the internal surface by blasting and/or by shaking and/or rotating.

BRIEF DESCRIPTION OF THE DRAWINGS

The subject matter of the disclosure ill be explained with reference to the drawings. In the drawings.

DETAILED DESCRIPTION OF THE PREFERRED EMBODIMENT

Figure 1:
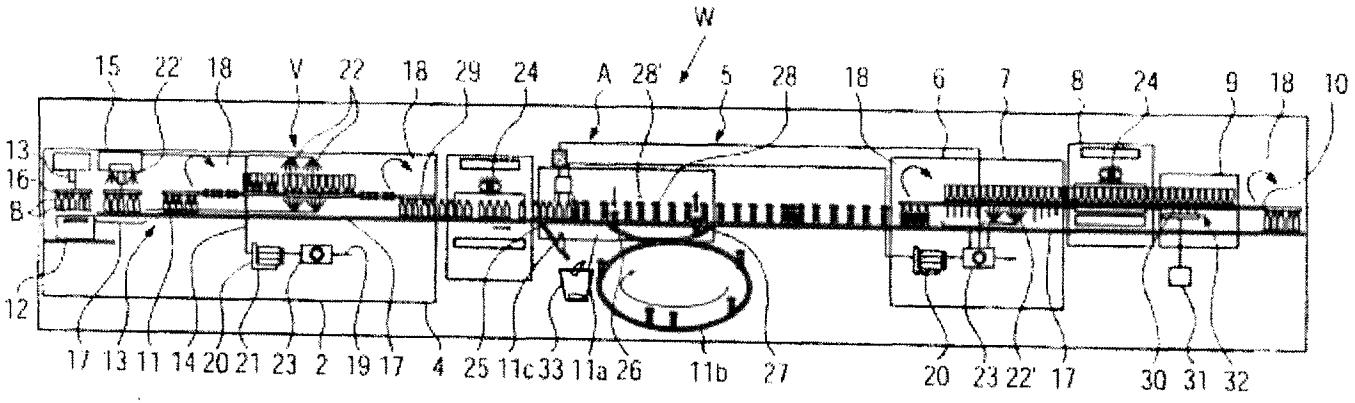
FIG. 1 shows a schematic representation of a cleaning machine for containers, here bottles of plastics or glass.
Figure 2:
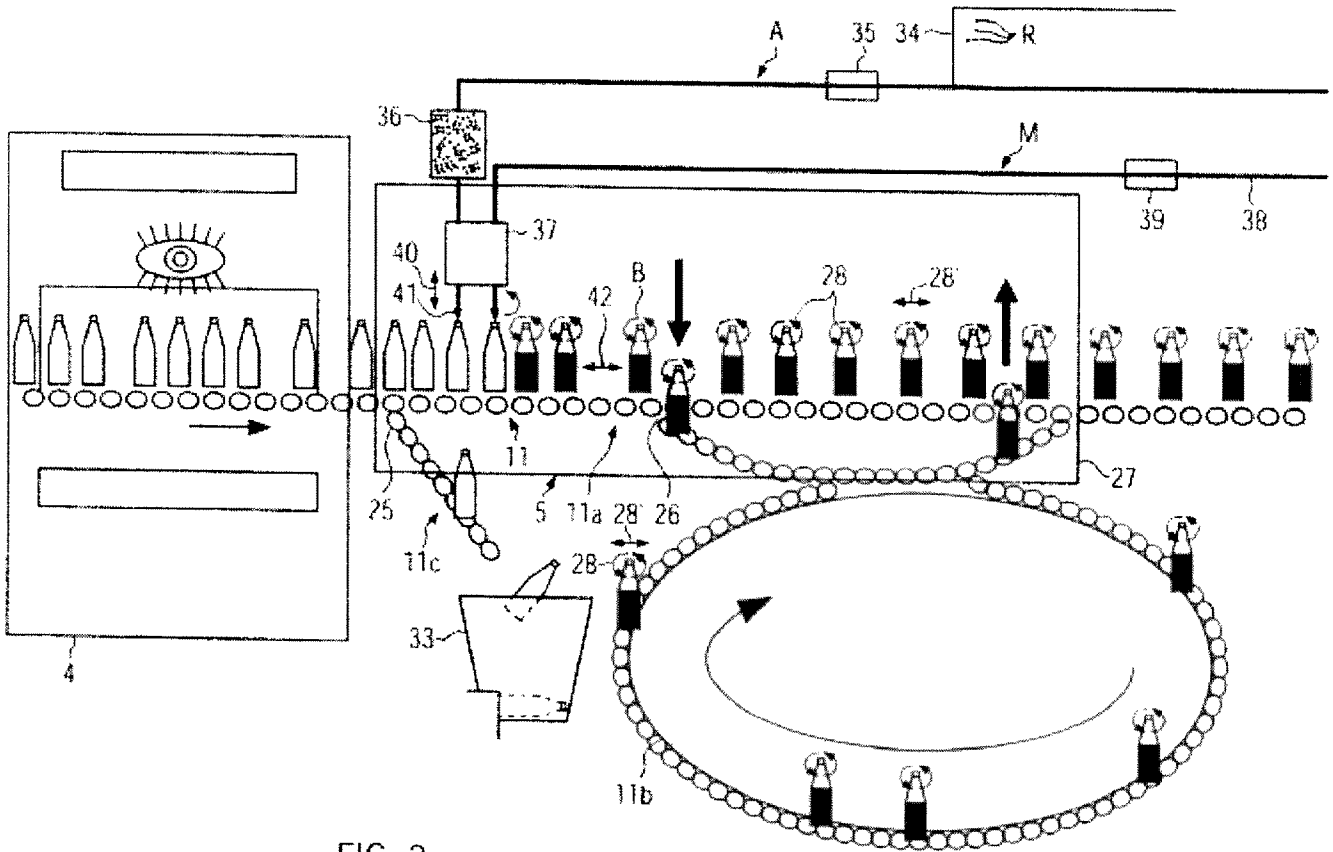
FIG. 2 shows an enlarged detail of the cleaning machine of FIG. 1, and FIGS. 3 to 5 show schematic representations for illustrating a procedure step in the intensive cleaning of the containers.

A cleaning machine W shown in FIGS. 1 and 2 serves, for example, for cleaning containers B which are at least predominantly returned by consumers and refilled according to a multi-cycle principle. These can especially be plastic or glass bottles for the beverage industry for which very high cleaning and hygienic standards must be kept for refilling.

The cleaning machine W shown in FIGS. 1 and 2 is designed as linear machine, but alternatively, it could also be a rotary machine.

In the cleaning machine W, several stations 1 to 10 are connected in series in the conveying direction of the containers B. A conveyor line 11 for upright transport extends through all stations, auxiliary conveyor lines 29 for example for suspended transport or overhead transport being associated to them in parallel.

Station 1 is an unpacking and presoaking station. The containers B are lifted for example out of transport units 12 by means of a gripper 13, 16 and placed onto the conveyor line 11, e.g. a belt conveyor, such that the container openings face upwards. The containers are wetted with water on the external surface as well as inside by a presoaking means 15 with water spray nozzles 22', where the water can have room temperature and is free from chemicals to presoak dirt present inside and/or outside and possible labels or wrap-around labels.

In the inlet of the station 2, which is a pre-cleaning station, a presoaking station 3 is provided, to which a turning device 18 is associated which places the containers on the auxiliary conveyor line 29 so that they stand on their heads, so that the water introduced for presoaking can run off possibly together with released dirt. In the station 2, high-pressure blast nozzles 22 are arranged at least at the top and bottom side which are optionally movable and remove dirt, glue and labels with high pressure water jets ("Kaerchern"). The running off water is collected, together with the released dirt accumulations, by collecting means 17, supplied to a pre-cleaning means 23 and then cleaned in a main cleaning device 20 and returned to the cycle via a conduit 14. In the pre-cleaning device 23, solids and solid dirt can be removed at 19. In the main cleaning device 20, "real" waste water can be discharged at 21.

In the outlet of the pre-cleaning station 2, another turning means 18 is provided which turns the containers B by 180° and places them on the conveyor line 11 before the pre-cleaned containers B enter the next station 4 which serves, among others, for differentiating dirt by means of an inspection means 24.

The next station 5 is an intensive cleaning station in which the containers B are intensively cleaned with at least one cleaning medium free from chemicals at least as far as possible. In the course of the conveyor line 11, three distributing guides 25, 26 and 27 can be provided in the station 5. The distributing guide 25 is, for example, controlled by the inspection means 24 to sort out containers that have a predetermined detected level of dirt, can no longer be cleaned, are faulty or cannot be reused, and to convey them, for example, to a collector 33. The distributing guide 26 located somewhat further downstream is, as the distributing guide 27 located still further downstream, associated to a second intensive cleaning section 11*b* in parallel to the here linear intensive cleaning section 11*a* in the station 5, which is, however, longer. At least the distributing guide 26 can be controlled by the inspection means 24 to convey containers, depending on the detected level of dirt which is lower than the level of dirt previously detected for sorting out, individually along the longer intensive cleaning section 11*b* or the shorter intensive cleaning section 11*a*. Between the distributing guides 26, 27, the consecutively conveyed containers can be spaced apart such that containers returned from the second intensive cleaning section 11*b* can be easily introduced into the first intensive cleaning section 11*a*.

In the station 5, a blasting system A is arranged which processes for example granular material R which is allowed to act on the containers B e.g. directly or via a carrier medium, such as air or water, at a high pressure and high speed at least abrasively, preferably in the interior and in the opening region of the containers. The high pressure blasting system A will be illustrated more in detail with reference to FIG. 2. Downstream of the blasting system A, means 28 can be provided to rotate the containers while they are being conveyed. The thus generated relative motion between the filling of the cleaning medium and the container serves further cleaning.

The means 28 for example provided downstream of the blasting system A can be additionally combined with means 28' which set the containers in shaking motion, or they can alternatively be replaced by the means 28' which set the containers with at least a partial filling of either only dry, granular material R, a mixture with a carrier medium, such as water, in shaking motion for inside cleaning. The shaking of the containers for internal cleaning is particularly advantageous when granulated nutshell material is used as the granular material R.

The station 6 contains another turning means 18 in which the containers B approaching in an upright position are brought into an overhead position to empty them. The following station 7 is a rinsing station in which the overhead containers are finally rinsed inside and outside with water or high-pressure water. The stations 6, 7 are followed, as station 2, by a pre-cleaning device 23 and a main cleaning device 20 for collected water and optionally granular material R or melted ice, which supplies cleaned water, here to the blasting system A, and separates water collected in collecting means 17 from dirt.

The station 8 contains another inspection device 24 for automatically detecting possibly remaining dirt, where a non-depicted sorting-out station and/or return device can be controlled by the inspection device 24 in order to sort out not sufficiently cleaned containers or to return them into the station 2 or into the station 5.

The disinfection station 9, for example for flame disinfecting the containers B e.g. conveyed overhead, contains nozzles 30 which are supplied from a reservoir 31 with a gas, such as e.g. ozone or a substance combustible without leaving any residue, to fill the containers before an ignition means 32 initiates combustion to perform the disinfection of the containers with the formed flames, mainly inside and in the opening region also outside.

Advantageously, ozone is employed in the disinfection station 9 which can be applied preferably by at least one energy pulse, e.g. piezoelectrically, to provide sustainable disinfection, while the ozone is consumed without leaving any residue (e.g. is decomposed into oxygen and free radicals).

In the station 10, another turning device 18 follows the disinfection station 9 which transfers the containers B from their overhead position again to the upright transport on the conveyor line 11.

FIG. 2 schematically illustrates the stations 4 and 5 of the cleaning machine W of FIG. 1. In this embodiment of the cleaning machine W, the station 5 is designed with the here two (or several) intensive cleaning sections 11*a*, 11*b* of different lengths for intensive cleaning using a granular material R. This granular material should have a certain grain size, should be capable of being added without leaving any residue or even of being consumed during the intensive cleaning without leaving any residue, e.g. of completely melting to water as slurry ice, not generating any dust, and not damaging the surface, especially in the opening region or inside the container, but completely release e.g. presoaked dirt accumulations at least with an impact energy and/or by abrasive action.

The granular material R can consist of metal, plastics, sand, salt or the like, salt having the advantage that it is gradually dissolved at least in contact with water. As an alternative, the granular material R in FIG. 2 is ice, i.e. either dry ice of carbon dioxide or water ice (slurry ice) of chemical-free water, for example in pellet form with a certain grain size.

The ice grains are advantageously carried under pressure either directly or with a carrier medium and applied. The carrier medium M is either compressed air or compressed water. The ice-blasting technique combines several advantages. The ice grains or particles having a size of about 2.0 mm are applied onto the surface to be cleaned or injected into the containers at a pressure of about 5 bar e.g. with compressed air. In the process, the ice grains clean in a mechanical way through their impact energy and abrasion. They gradually melt and rinse off released dirt from the surface. Dry ice of carbon dioxide evaporates without leaving any residue. With water ice (slurry ice), the ice-blasting technique can be employed even in closed rooms. In case of dry ice, it is recommended to suck off the carbon dioxide that is formed. Even sensitive surfaces are not damaged by the relatively soft ice grains in intensive cleaning. Therefore, no dust is formed which would have to be removed separately.

As already mentioned, rotary devices 28 are provided in the station 5 to rotate the containers at least partially filled with the cleaning medium (granular material R and carrier medium M, such as air or water) either in one sense of rotation or in alternating senses of rotation while they are being conveyed further, so that a relative rotary motion is created between the cleaning medium filling in each container and the container inner wall, wherein partly or largely released dirt can be finally rinsed off and kept moving, and wherein mainly the granular material R further abrasively acts on the inner wall and rinses the same together with the carrier material, whereby the granular material is moved outwards and brought into contact with the inner wall by centrifugal force. Thus, the granular material has a double effect, first during pressure blasting from the blast gun 40, and then in the rotary motion.

If ice is used as granular material R (dry ice or water ice), the granular material also has at least two cleaning effects. Apart from the abrasive effect, i.e. due to the impact energy while the inner wall of the container B is blasted or during the injection into the container, struck) dirt accumulations contract and embrittle due to supercooling (in case of dry ice of carbon dioxide for example −79° C.), if they have not been broken up and released immediately. By thermal stresses that develop and under the influence of the impact or kinetic energy of the ice grains, these dirt accumulations then get easily released from the surface. At least the ice grains that impact subsequently remove these already partially released dirt accumulations completely. If dry ice is used, it completely dissolves to gas after the impact which returns to the atmosphere from which it was originally recovered. If dry ice is used, there are practically no liquid residues, so that the abrasive cleaning effect during blasting, optionally with several moving cycles of the blast nozzles 41 or the blast gun 40, respectively, down to the bottom of the container, is very efficient. Optionally, water could be employed in addition. In case of grains of water ice which are blasted on directly or with compressed air or compressed water, the same gradually melts whereby released dirt accumulations are efficiently rinsed off and kept in circulating motion in the container and do not deposit again.

The station 5 in FIG. 2, which represents the intensive cleaning station of the cleaning machine W for example of FIG. 1, comprises a reservoir 34 for granular material R, particular ice pellets, such as slurry ice, or is connected to such a reservoir. The reservoir 34 can be insulated and/or cooled. A supply extends from the reservoir 34 via a dosing device 35 to a mixing device 37, to which another supply 38 for the carrier medium M, in this case water, for example from station 6, 7, or chemical-free pure water is connected. A pressure and/or quantity control means 39 or the like can be contained in this supply 38. In case of dry ice of carbon dioxide or slurry ice, compressed air, for example from a compressor, can be supplied to the mixing device 37 via a pressure control and quantity adjustment device.

To ensure that no additional germs are introduced during intensive cleaning, a disinfection device 36 can be provided at least for the granular material R.

At least one blast gun 40 is supplied by the mixing device 37, which preferably has special high-performance nozzles 41 and can be optionally adjusted in the direction of the arrows in FIG. 2 relatively to the conveyor line 11, 11*a* linearly and/or rotatingly.

For the case that at least two intensive cleaning sections 11*a*, 11*b* of different lengths and the distributing guides 27 are provided, a separation device 42 is provided downstream of the blast gun 40 (advantageously a group of blast guns), to space apart the containers B consecutively transported along the conveyor line 11.

For example, in FIG. 2, the ice grains fall out of the reservoir 34 via the dosing means 35 into an outlet knee of the blast gun 40 which is supplied with compressed air and generates a relatively gentle suction pressure for the ice grains. Through the compressed air, the ice grains are accelerated to about 300 m/s. Through the exactly calculated high-performance blast nozzles 41, the cleaning medium is now blasted out of the ice grains (pellets) and the compressed air onto the surface of the container to be cleaned, e.g. the internal surface and the opening region. A pressure of about 5 bar can be employed for this. Of course, the aforementioned grain sizes, the pressure range and the speed can be varied within a wide range.

If the granular material is metal, plastics, sand, salt or the like, either compressed air or compressed water can also be used as carrier medium. The use of ice, in particular slurry ice, as the granular material is preferred as it has a less aggressive effect on the containers and either evaporates or melts to water. With other granular materials, the granular material employed in each case and which is excessive or accumulates after use must be collected e.g. via the collecting means 17 (troughs or the like) and separated and reprocessed separately beforehand when the water is reprocessed. In contrast, salt can be removed in the dissolved state by desalting when the water is processed and either disposed of or reused.

As the granular material R, a granulated nutshell material, for example having a particle size of about 0.1 mm to 1.0 mm, preferably to about 0.8 mm, can be advantageously used for the internal and/or external cleaning of the containers in the intensive cleaning station. Granulated nutshell material is an inexpensive cleaning material which is biodegradable and optionally easy to recycle and is available practically all over the world in almost unlimited quantities as renewable raw material, and which is, for example, a waste product of production processes where nut kernels are processed. The granulated nutshell material can be blasted and/or filled in for the intensive cleaning in a dry state, or for example with water as a carrier medium. For the internal cleaning with granulated nutshell material, the container can be shaken and/or rotated, whereby e.g. standard dirt accumulations are quickly released and easily removed. In the external cleaning, granulated nutshell material has proved to be particularly efficient for removing labels, label residues and glue or glue residues.

In the station 5, several substations could be employed each with blast guns 40 or blast nozzles 41, where the containers can be advantageously turned between these substations to be each disposed of their contents of cleaning medium and dirt accumulations. Advantageously, there is a certain residence time in the station 5 within which the cleaning medium acts at least in the interior of the container while it is agitated. After the containers have left the station 5, they are turned (FIG. 1) by the turning means 18 in the station 6, so that their contents run off (and are collected and optionally reprocessed while no longer reusable partial substances are separated) before the containers are rinsed with chemical-free water in the station 7.

Figure 3:
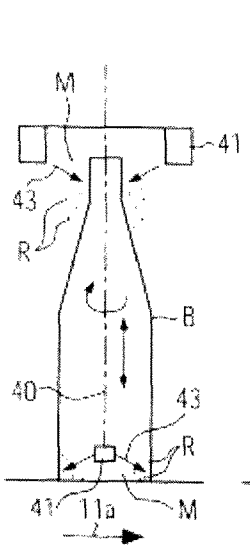
Figure 4:
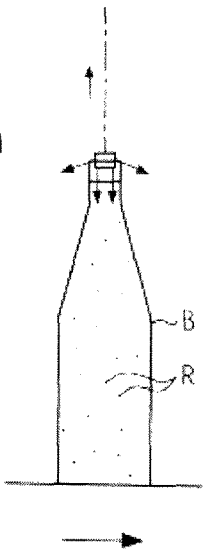
Figure 5:
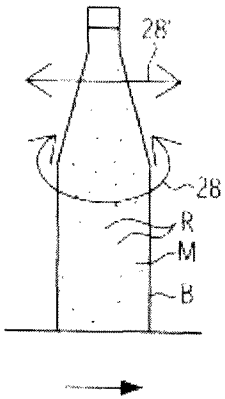

FIGS. 3 to 5 schematically illustrate the course in the intensive cleaning of a container B, for example in the station 5 in FIGS. 2 and 1.

In FIG. 3, pressure blasts 43 from the blast nozzles 41, which are generated from the granular material R and optionally the carrier medium M, e.g. of dry ice or water ice pellets carried with compressed air, act on the empty container B standing on the intensive cleaning section 11*a* and facing upwards with its opening region. The blast gun 40 is for example introduced in the container B with the bottom blast nozzles 41 to blast the inner wall gradually from the container inner bottom towards the top. In the process, the blast nozzles 41 can be moved up and down and/or rotated in the direction of the shown arrows. Optionally, blast nozzles 41 for cleaning the external opening region are also provided at the blast gun 40. Furthermore, several blast nozzles 41 can be provided over the length of the blast gun 40.

In an alternative embodiment, the blast gun 40/blast nozzle 41 is essentially placed stationarily, such that it only injects the cleaning medium into the container B, while the container can be e.g. either temporarily stopped, or the blast gun can temporarily move along with the container, or injection is only performed over the period during which the container B passes the blast nozzle 41.

In both cases, according to FIG. 4, a filling or partial filling of the granular material R and the carrier medium M is then contained in the container when the container B moves further out of the region of the blast gun 40. Now, the container B is rotated, for example about its vertical axis, by the rotary devices 28, so that, for further cleaning, a relative motion is developed between the filling with liquid friction with respect to the container and its inner wall, in which partially released or released dirt accumulations are finally released and entrained and kept moving, and, for example by centrifugal forces or fluid dynamics, the granular material R is still pressed against the inner surface and releases, also with mechanical friction, any dirt residues which are then kept moving in the filling of the granular material R and the carrier medium M and are no longer deposited. In the process, a predetermined residence time is allowed for this intensive cleaning in the intensive cleaning section 11*a* which can, for example, individually depend on the level of dirt detected by the inspection device 24. In case of a higher level of dirt, the respective containers are treated for a longer time in the longer intensive cleaning section 11*b*. Subsequently, the container shown in FIG. 5 is turned by the turning means 18, such that the filling of the granular material R, the carrier medium M and the released dirt accumulations can run off, a certain period being allowed for the containers to drip off well before they are intensively rinsed with water in the station 7.

In FIG. 4, as an alternative or in addition to the means 28 for rotating the containers, at least one means 28' for shaking the containers can be provided to subject the same to the abrasive effect of the granular material R at the inner surface during internal cleaning. The shaking, with or without simultaneous rotation, is particularly advantageous if granulated nutshell material is used as the granular material R.

In the disinfection station 9, gas or another substance combustible without leaving any residue is injected into the container B and e.g. ignited, and the flame generated after ignition is also specifically directed to the outer side of the opening region of the container to also disinfect this region. Preferably, ozone and optionally piezoelectrically generated energy pulses of a generator are employed.

The procedure with slurry ice, performed largely free from chemicals and without any noteworthy use of thermal energy, sorting out of excessively dirty or no longer usable containers B already before intensive cleaning, at least one penalty round of more heavily soiled containers, and the disinfection with ozone is considered to be particularly advantageous and inexpensive for several reasons. By automatic inspection and sorting out before intensive cleaning, a predetermined admissible level of dirt is limited which can be deliberately adjusted to the cleaning capacity of the granular material R, e.g. slurry ice. Hardly or only slightly soiled containers B are then cleaned speedily. More heavily soiled containers B, optionally to the predetermined level of dirt, are cleaned for a longer period or even several times, optionally with further application of the granular material, where granular material could be absolutely applied several times along the intensive cleaning section. In case of slurry ice or water ice, the same melts to water which is removed with the dirt by turning the containers only through gravity and/or rinsed with pure water without leaving any residue. By the residence time necessary for running off until disinfection is performed, the intensively cleaned surfaces are, if at all, only slightly wetted, so that the ozone can develop its disinfection effect very efficiently, optionally supported by energy pulses which easily act in the ozone in a piezoelectric (or any other) manner, the ozone being consumed to form oxygen and free radicals without leaving any residue. Altogether, one can thus save a lot of costs compared to conventional methods, mainly as no chemicals, hardly any thermal energy introduced from outside or into cleaning media, and much less water are employed.

The containers sorted out mainly in the inspection station 24 do not necessarily have to be rejected but can be collected for saving further costs and be cleaned separately in another, e.g. more aggressive manner, or specially pre-cleaned and then reintroduced to the method for a new trial, as this can absolutely be a noteworthy proportion of all containers to be cleaned, which is deliberately first sorted out to limit the predetermined level of dirt adjusted to the method and/or the cleaning capacity of the granular material R, in particular slurry ice.

An important aspect is to provide, in intensive cleaning, a level of dirt deliberately restricted e.g. to the efficiency of the method or the cleaning effect of the granular material by sorting out containers detected to be unsuited. This is advantageously performed after pre-cleaning to achieve higher detection precision.

It can also be advantageous to arrange a rinsing station between the intensive cleaning station and the disinfection station, in which the containers are rinsed inside or outside with chemical-free water, optionally as a precaution.

The invention claimed is:

1. A method for cleaning containers, in a cleaning machine, in which in several stations and process steps, at least one cleaning medium is allowed to act on the containers conveyed by the cleaning machine, comprising cleaning the containers in at least one station with at least one cleaning medium; and wherein in at least one pre-cleaning step, wetting each container with chemical-free water essentially on all sides, presoaking dirt accumulations present on each container for a predetermined period, pre-cleaning an exterior of each container by blasting with chemical-free compressed pure water, subsequently internally cleaning each container over at least one further predetermined period at least by pressure blasting an inner surface of the container with granular material and a carrier medium, subsequently rinsing each container with chemical-free water, and finally disinfecting each container by applying ozone to the container.

2. The method according to claim 1, further comprising intensively cleaning at least the inner surface of each container with said granular material carried in one of water or air as the carrier medium.

3. The method according to claim 1, wherein the containers comprise non-sorted out containers, and cleaning the non-sorted out containers depending on a detected level of dirt.

4. The method according to claim 1, wherein before final disinfection, detecting incompletely cleaned containers.

5. The method according to claim 1, further comprising imparting a rotary motion between the container and the granular material present on the inner surface of the container.

6. The method according to claim 1, wherein ozone is applied using an energy pulse.

7. The method according to claim 2, wherein the granular material is selected from the following group individually or in combination: metal, plastics, sand, and salt.

8. The method according to claim 2, further comprising cleaning at least the inner surface of each container with granular ice.

9. The method according to claim 2, wherein, for cleaning the inner surface of each container, a granulated nutshell material as the granular material is allowed to act on the inner surface of the container by means of said carrier medium.

10. The method according to claim 2, wherein the granular material is recyclable and/or degradable without leaving any residue.

11. The method according to claim 6, wherein the energy pulse is piezoelectric.

12. The method according to claim 8, wherein the granular ice is dry ice of carbon dioxide or water ice that is blasted or injected as the granular ice.

13. The method according to claim 12, wherein the water ice is slurry ice.

14. A method for cleaning containers, in a cleaning machine, in which in several stations and process steps, at least one cleaning medium is allowed to act on the containers conveyed by the cleaning machine, comprising cleaning the containers in at least one station with at least one cleaning medium; and wherein in at least one pre-cleaning step, wetting each container with chemical-free water essentially on all sides, pre-soaking dirt accumulations present on each container for a predetermined period, pre-cleaning an exterior of each container by blasting with chemical-free compressed pure water, subsequently internally cleaning each container over at least one further predetermined period at least by pressure blasting an inner surface of the container with granular material and a carrier medium, subsequently rinsing each container with chemical-free water, and disinfecting each container, wherein disinfecting each container comprises, on at least an inside and in an opening of the container, application and combustion of gas or of a substance combustible without leaving any residue.

* * * * *